US012702899B2

(12) United States Patent
Evrard

(10) Patent No.: US 12,702,899 B2
(45) Date of Patent: Aug. 11, 2026

(54) BALL COLLECTING AND RETURNING INSTALLATION

(71) Applicant: Court 16, Inc., Brooklyn, NY (US)

(72) Inventor: Anthony Evrard, New York, NY (US)

(73) Assignee: COURT 16, INC., Brooklyn, NY (US)

( * ) Notice: Subject to any disclaimer, the term of this patent is extended or adjusted under 35 U.S.C. 154(b) by 408 days.

(21) Appl. No.: 18/409,444

(22) Filed: Jan. 10, 2024

(65) Prior Publication Data

US 2025/0222310 A1 Jul. 10, 2025

(51) Int. Cl.

| | |
|---|---|
| ***A63B 47/02*** | (2006.01) |
| ***A63B 61/00*** | (2006.01) |
| ***A63B 63/00*** | (2006.01) |

(52) U.S. Cl.

CPC ..... *A63B 47/025* (2013.01); *A63B 61/003* (2013.01); *A63B 63/00* (2013.01); *A63B 2063/001* (2013.01)

(58) Field of Classification Search

CPC ..... A63B 47/025; A63B 61/003; A63B 63/00; A63B 2063/001; A63B 2102/02; A63B 69/38; A63B 71/022

USPC ..... 473/197, 421, 422, 434, 435, 446, 449, 473/454–456, 470, 471, 476–478, 433, 473/436, 447, 431, 479, 483, 489, 409

See application file for complete search history.

(56) References Cited

U.S. PATENT DOCUMENTS

| | | | | | |
|---|---|---|---|---|---|
| 3,989,246 | A * | 11/1976 | Brown | A63B 47/025 | 124/53.5 |
| 4,025,071 | A | 5/1977 | Hodges | | |
| 4,108,432 | A | 8/1978 | Clark et al. | | |
| 4,575,081 | A | 3/1986 | Cavanagh | | |
| 4,606,543 | A | 8/1986 | Hartland | | |
| 4,974,843 | A * | 12/1990 | Henningsson | A63B 47/025 | 473/431 |
| 4,978,121 | A * | 12/1990 | Larkey | A63B 69/0002 | 473/497 |
| 5,141,226 | A | 8/1992 | Cavanagh | | |
| 5,573,239 | A * | 11/1996 | Ryker | A63B 63/00 | 473/436 |
| 5,733,209 | A | 3/1998 | Mcintyre | | |
| 6,620,064 | B2 | 9/2003 | Nickerson | | |
| 7,066,845 | B2 | 6/2006 | Joseph | | |
| 7,156,761 | B2 | 1/2007 | Mesa | | |
| 9,039,012 | B2 * | 5/2015 | O'Sullivan | A63B 63/004 | 273/408 |
| 11,083,953 | B2 | 8/2021 | Hermandorfer | | |
| 2005/0159251 | A1 | 7/2005 | Houston et al. | | |

(Continued)

*Primary Examiner* — Nini F Legesse

(74) *Attorney, Agent, or Firm* — Holtz, Holtz & Volek PC

(57) ABSTRACT

Ball collecting and returning installation for a court surface includes a back wall having a ball inlet opening and a ball outlet opening, a damping net spaced apart from and in front of the back wall and which has an opening at least partly aligning with the ball outlet opening, and a trough below the damping net and extending from the back wall to a location in front of the damping net. The trough guides balls landing therein to the ball inlet opening through which the balls pass into a ball collection receptacle behind the back wall. A ball propulsion device is also behind the back wall, elevated on a platform above the ball collection receptacle, and receives balls from the ball collection receptacle and propels them through the ball outlet opening onto the sports court surface.

20 Claims, 3 Drawing Sheets

(56) References Cited

U.S. PATENT DOCUMENTS

| | | | | |
|---|---|---|---|---|
| 2006/0229146 | A1 | 10/2006 | Giegerich | |
| 2010/0292033 | A1* | 11/2010 | Sarver | A63B 63/00<br>473/431 |
| 2012/0040781 | A1 | 2/2012 | Edmiston et al. | |

* cited by examiner

BALL COLLECTING AND RETURNING INSTALLATION

FIELD OF THE INVENTION

The present invention relates to a ball collecting and returning installation for practicing tennis strokes on a sports court, such as a pickleball court, including a damping net against which the tennis balls are hit by the player, a ball propulsion device that propels the balls to the player, and a guide and collection structure to guide balls collected after hitting the damping net to the ball propulsion device.

The present invention relates to a ball collecting and returning installation for practicing serving tennis balls using a sports court such as a pickleball court.

The present invention also relates to a method for installing a ball collecting and returning installation on a ball court such as a pickleball court.

BACKGROUND OF THE INVENTION

Structures that provide for the return of tennis balls hit by a player to a ball propulsion device to enable the player to continuously receive tennis balls to hit are known. For example, U.S. Pat. No. 4,025,071 (Hodges) describes a tennis ball recovery system in which a damping net is arranged behind a net having the height of a tennis court net and receives balls hit over this tennis court net-height net. The balls fall onto ramps which guide the collected balls to a feeder that feeds the balls to a ball propulsion machine.

Also, U.S. Pat. No. 4,575,081 (Cavanagh) describes a tennis ball recovery system for a tennis court having a back fence in which a damping screen is mounted spaced apart from the back fence and a horizontal trough is positioned below a bottom edge of the damping screen. The damping screen is attached at its upper end to the back fence. Tennis balls drop into the trough and are conveyed to a ball propulsion device.

Problems with this type of tennis ball recovery system having vertically oriented damping screens are that balls sometimes bounce back onto the court since the screens either hang loosely or are stretched in a vertical attitude above the ball-collecting trough, and also that balls sometimes drop from the screen to the trough and then bounce out of the trough since their motion is not sufficiently damped.

In this regard, U.S. Pat. No. 5,141,226 (Cavanagh) provides for a tennis ball recovery system that includes a screen attached at its top to a vertical structure to assume a suspended state over a trough that serves as a horizontal ball return channel. The bottom of the screen is attached to the trough. In use, tennis balls hit the screen, slide downward along the screen into the trough, are retained in the trough by walls thereof, and are conveyed through the trough to a ball serving machine.

OBJECTS AND SUMMARY OF THE INVENTION

It is an object of at least one embodiment of the present invention to provide a new and improved ball collecting and returning installation for practicing tennis strokes while providing for a continuous stream of balls to hit.

It is another object of at least one embodiment of the present invention to provide a tennis ball collecting and returning installation for practicing serving tennis balls using a smaller court such as a pickleball court.

It is another object of at least one embodiment of the present invention to provide a new method for installing a ball collecting and returning installation on a ball court, such as a pickleball court.

In order to achieve one or more of the above objects, and possibly others, a ball collecting and returning installation in accordance with the invention includes a back wall having a ball inlet opening and a ball outlet opening, a damping net spaced apart from and in front of the back wall, a trough below the damping net and extending from the back wall to a location in front of the damping net, and a ball propulsion device behind the back wall. To provide a potentially continuous stream of balls to a player in front of the installation to hit toward the installation, the trough guides balls landing in the trough, after striking the damping net and falling into the trough, to the ball inlet opening, and the ball propulsion device receives balls that pass through the ball inlet opening and propels the balls through the ball outlet opening. The damping net has an opening at least partly aligning with the ball outlet opening to avoid interfering with the propulsion of the balls through the ball outlet opening by the ball propulsion device.

In one embodiment, the back wall includes a vinyl sheet on a front side above the trough and that has an opening aligning with the ball outlet opening to avoid interfering with the propulsion of the balls through the ball outlet opening. The vinyl sheet preferably has targets marked thereon correlated to targeted areas into which the user could hit balls during use of the installation. Also, the vinyl sheet preferably includes a horizontal line at a height of a tennis net relative to a surface of a ball court on which the installation is located to enable the player to assess the accuracy of their serve.

The damping net is preferably fixed in position a set distance from the back wall over its entirety, which distance is set in order to prevent the damping net from contacting the back wall upon being stricken by a hit ball (to reduce noise). Also, the damping net may be fixed at its lateral edges and its upper edge to at least one stationary structure, while a bottom edge is free and over the trough. The damping net has a predetermined tension to damp movement of balls striking it to thereby cause the balls to roll along the damping net into the trough or drop from the damping net into the trough.

The trough includes opposed side walls projecting from the back wall and a front wall connected to and extending between a front region of the side walls to define a ball catching receptacle. The front wall has a height at or above a bottom edge of the damping net. The bottom surfaces of the trough are angled toward the ball inlet opening in the back wall.

In one embodiment, there is a ball collection receptacle behind the back wall that is positioned to receive balls passing through the ball inlet opening. The ball propulsion device may be elevated above the ball collection receptacle and have a conduit to retrieve balls from the ball collection receptacle, and through which balls are transferred from the ball collection receptacle to an inlet of the ball propulsion device. To this end, there may be a platform to elevate the ball propulsion device such that a trajectory of balls outlet from the ball propulsion device is downward and enables the balls to clear a court net if present on the sports court.

In particular if used to practice serving for tennis, a ball facility in accordance with the invention, which includes the above installation in any of its configurations, also includes a tennis court having a court surface and a net, with the installation being situated at one end of the court surface.

The court surface include one or more tennis serve lines extending transversely across the court surface, while the back wall includes a horizontal line at a height of a tennis net. Each tennis serve line may be positioned a distance of about 25 feet, about 30 feet, about 35 feet or about 36 feet from the back wall (the different distances being for different skill levels of the users). In use, a player serving from the tennis serve line assesses their serve by seeing whether it impacts the damping net above or below the horizontal line.

A method for installing a ball collecting and returning installation on a sports court in accordance with the invention includes providing a back wall having a ball inlet opening and a ball outlet opening at one end of a court surface of the court, arranging a damping net spaced apart from and in front of the back wall and which has an opening at least partly aligning with the ball outlet opening, constructing a trough below a free lower edge of the damping net and extending from the back wall to a location in front of the damping net, providing the trough with guide structure to guide balls landing in the trough to the ball inlet opening of the back wall, positioning a ball propulsion device behind the back wall, and coupling an inlet of the ball propulsion device to a ball collection receptacle into which the balls pass from the trough. With this structure, balls falling from the damping net into the trough are conveyed to the ball propulsion device to be outlet onto the court to potentially provide a continuous stream of balls to the players, as long as the player hits them into the installation.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
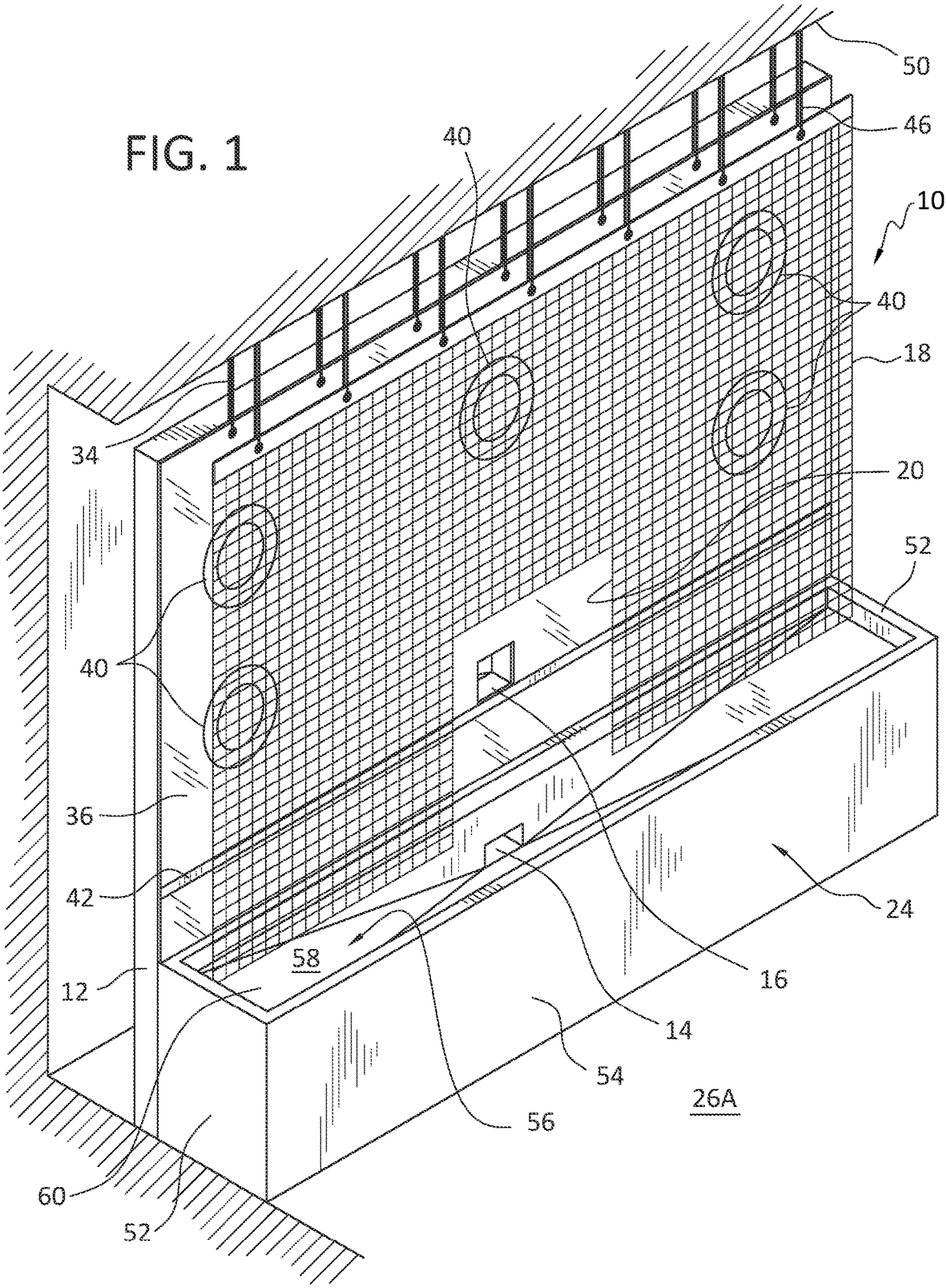
FIG. 1 is a perspective view of a tennis ball collecting and returning installation in accordance with the invention.

Referring to the accompany drawings wherein the same reference numbers refer to the same or similar elements, FIG. 1 is a perspective view of a tennis ball collecting and returning installation 10 in accordance with the invention which includes a back wall 12 including a ball inlet opening 14 in a central lower region and a ball outlet opening 16 in a central middle region, and a damping net 18 spaced apart from and in front of the back wall 12. The damping net 18 has an opening 20 aligning with the ball outlet opening 16 so that any balls propelled by a ball propulsion device 22 behind the back wall 12 pass through the ball outlet opening 16 and are not entangled in the damping net 18. A trough 24 in front of the back wall 12 and below the damping net 18 receives tennis balls that strike the damping net 18, and guides these tennis balls to the ball inlet opening 14 from which they are delivered to the ball propulsion device 22 (FIG. 2) to be propelled through the ball outlet opening 16.

Figure 3:
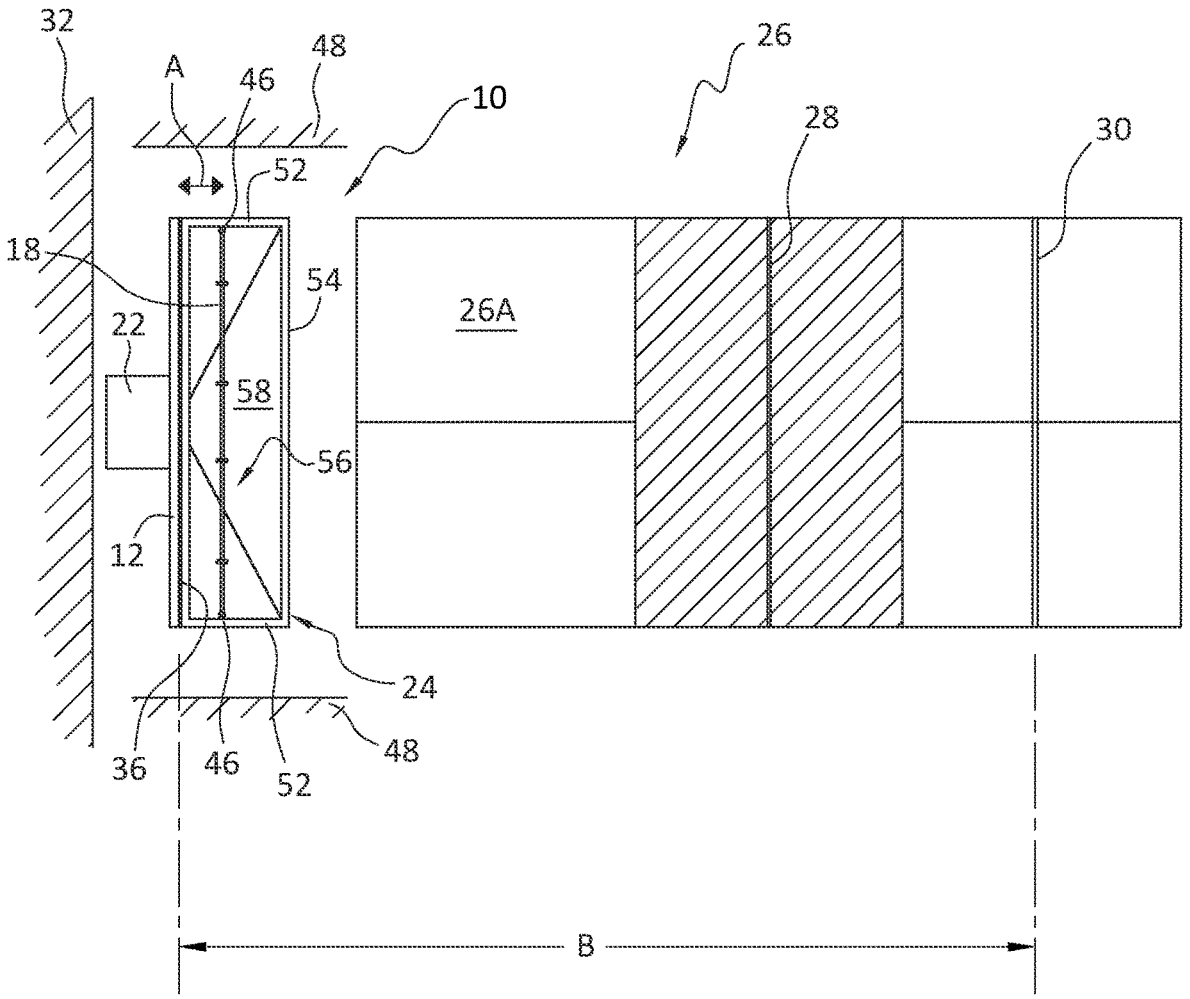
FIG. 3 is a top view of the tennis ball collecting and returning installation shown in FIG. 1 on a pickleball court.

The tennis ball collecting and returning installation 10 is designed for placement at an end of a sports court or playing court 26, such as a pickleball court, having a court net 28 (FIG. 3) and usual pickleball lines demarcating the non-volley zone and service court (FIG. 3). The court 26 can be used for pickleball as well as for practicing tennis strokes, both hitting tennis balls being propelled by the ball propulsion device 22 and serving. A tennis serve line 30 is therefore provided on an opposite, far side of the court net 28 from where the tennis ball collecting and returning installation 10 is situated. This tennis serve line 30 should be about thirty-five or thirty-six feet from the back wall 12 of the tennis ball collecting and returning installation 10 (distance B, FIG. 3), in an attempt to approximate real tennis court conditions for adult players at a standard or advanced level of play. However, it is contemplated that the tennis serve line 30 can be situated at a different distance from the back wall 12 of the tennis ball collecting and returning installation 10, such as about 25 feet for tennis players at the beginner level or about 30 feet for tennis players at an intermediate level. Moreover, it is possible to provide multiple tennis serve lines each at one of these different distances, or otherwise, for players at different levels of play.

A player uses the tennis ball collecting and returning installation 10 by standing on the far side of the court net 28 and hitting tennis balls propelled by the ball propulsion device 22 toward the tennis ball collecting and returning installation 10 which collects the tennis balls and feeds them to the ball propulsion device 22, thereby providing for a continuous flow of tennis balls to the player for practice purposes.

Referring back to FIG. 1, the tennis ball collecting and returning installation 10 may be installed in front of a vertical support wall 32 of an indoor or outdoor installation or facility in which tennis (or pickleball, or possibly another sport that uses a ball) is played. There are buildings that include indoor tennis courts that double as pickleball courts and often these buildings have vertical, usually solid walls at the ends of the court surfaces. The invention may be adapted for any installation or facility with a sports court.

Figure 2:
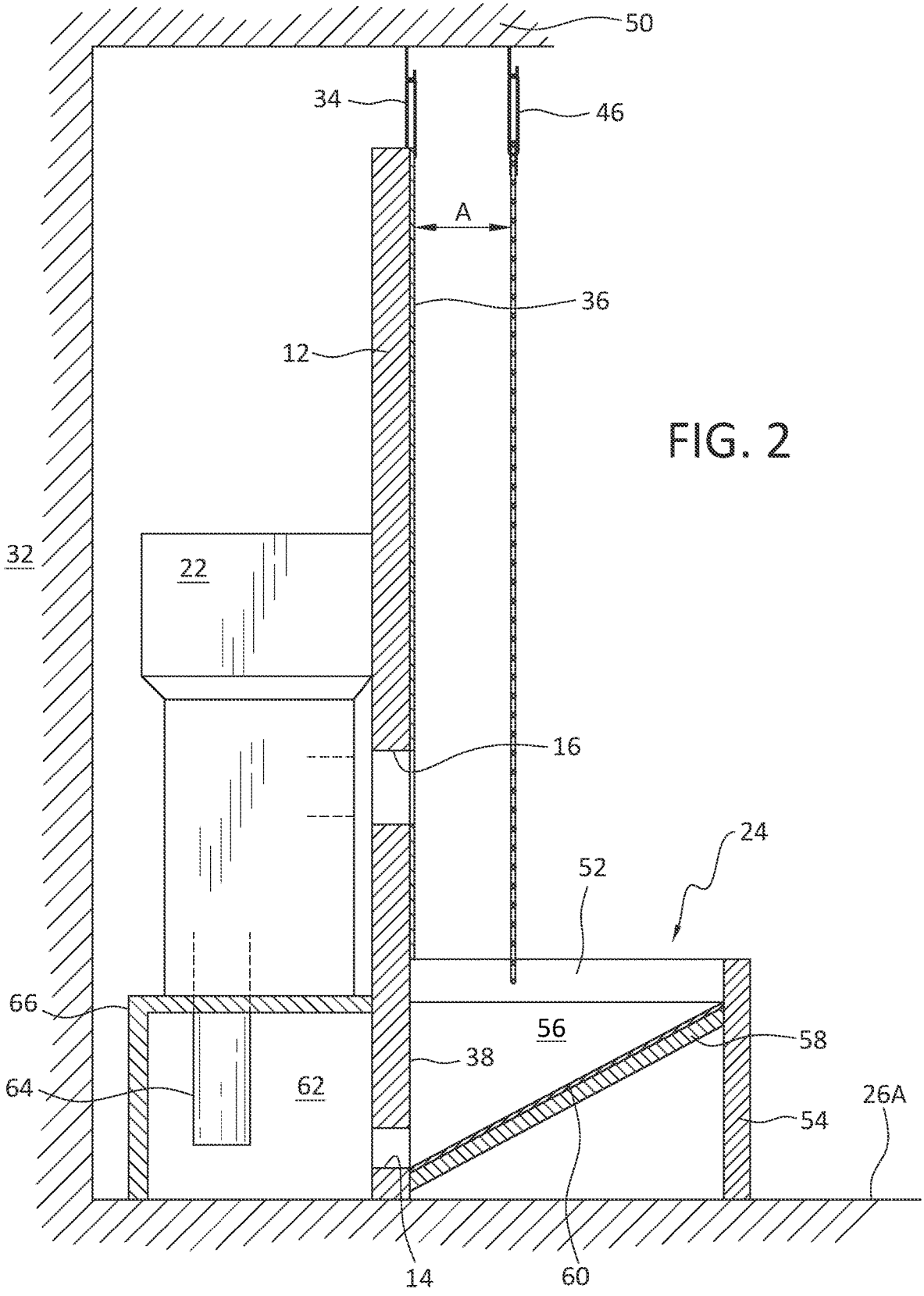
FIG. 2 is a cross-sectional view of the tennis ball collecting and returning installation of FIG. 1 taken through the ball inlet and outlet openings.

As shown in FIG. 2, the back wall 12 is spaced from one of these vertical walls 32 and may be a stationary wall formed on or integral with the surface of the sports court. If the vertical wall 32 does not extend to the ceiling of the facility, it may be fixed in position by, for example, attaching it to the ceiling of the facility by suitable attachment mechanisms 34. The ball propulsion device 22 is positioned in the space between the vertical wall 32 and the back wall 12 of the tennis ball collecting and returning installation 10 (FIG. 2).

Back wall 12 includes a vinyl sheet 36 at its front facing the court 26 over at least a portion of the back wall 12 above the trough 24. The portion 38 of the back wall 12 below the vinyl sheet 36 may be either part of the back wall 12 or part of the trough 24. This portion 38 may be made of the same material as the walls of trough 24, for example, a rigid material. The vinyl sheet 36 may be attached to a rigid, upright portion of the back wall 12 using any known attachment mechanism, or can be draped over the front surface of the rigid portion of the back wall 12 without being attached thereto. The rigid portion of the back wall 12 is in some embodiments, a built-in wall of the facility in which the sports court is situated or may be a specially constructed wall for use with the invention.

In view of the presence of the opening 20 in the damping net 18, it is unavoidable that some tennis balls might strike the vinyl sheet 36 of the back wall 12. The vinyl sheet 36 can thus be constructed in this area or in its entirety to provide damping for any balls and prevent them from bouncing back to the court 26, and also reducing or eliminating any noise arising from the balls striking the vinyl sheet 36.

Ball outlet opening 16 is shown in a central location midway between lateral sides of the back wall 12 and in a middle height location of the back wall 12. This location is not critical to the invention and may be varied, along with attendant changes in the location of a hole in the vinyl sheet 36 that must align with the ball outlet opening 16 and the outlet of the ball propulsion device 22 to provide for effective ball propulsion to the player on the court 26.

Targets 40 (FIG. 1) are preferably provided on the vinyl sheet 36 for use in practicing hitting balls during use, i.e., the player practicing could be directed to try to hit specific targets 40 at the different locations on the vinyl sheet 36 either when serving or returning balls propelled by the ball propulsion device 22. The position of the targets 40 on the vinyl sheet 36 can correlate to targeted areas for a tennis game, e.g., five targets representing different areas onto which to hit the tennis balls.

Vinyl sheet 36 is constructed to avoid wrinkling, e.g., through appropriate selection of its thickness. Instead of vinyl, other materials that exhibit the same or similar wrinkle-free property can be used.

A horizontal line 42 is also preferably provided on the vinyl sheet 36 at the height of a tennis net relative to the floor surface 26A of the court 26 (FIG. 3). Having horizontal line 42 on the vinyl sheet 36, the player can assess whether their balls are being hit while practicing serving, i.e., when serving from the tennis serve line 30, are above or below the net. If the player is practicing serving (not using the ball propulsion device 22), then a ball hitting the damping net 18 above the horizontal line 42 would be indicative of a good serve.

Damping net 18 is fixed in its position a set distance from the vinyl sheet 36 of the back wall 12 by attaching it to support structures by a net attachment mechanism 46. In an indoor building, the support structures typically includes one or more side walls 48 of the building and the ceiling 50 of the building in which the court 26 is formed. Damping net 18 is attached to the side walls 48 at its lateral edges and to the ceiling 50 at its upper edge by the net attachment mechanism 46. The bottom edge of the damping net 18 is not attached to anything and hangs free.

If the tennis ball collecting and returning installation 10 is not installed in a building, then there could be a self-standing vertical structure at one end of the practice court such as a court 26 that provides mounting locations for both the back wall 12 and the damping net 18.

The net attachment mechanism 46, or attachment means, secures upper and lateral edges of the damping net 18 a fixed distance from the back wall 12, i.e., from the front court-facing surface of the back wall 12 (distance A, FIG. 2). This distance A is optimally about 12 inches, but can vary between about 6 inches and about 18 inches. The manner of attachment of the damping net 18 to the side walls 48 and ceiling 50 by the net attachment mechanism 46 is not critical to the invention and numerous different techniques to attach a net to support structure may be used, e.g., anchoring or stitching the sides of the damping net 18 to foam side walls that are themselves fixed to solid or support walls of the building.

Damping net 18 is a mesh-type net with parallel longitudinal elements intercrossed with parallel transverse elements with a border along the longitudinal and transverse edges. The size of the apertures in the mesh is selected as desired. Whatever material and aperture size is selected, the damping net 18 must be structured to damp the movement of balls striking it and not allow them to bounce back onto the playing court 26. This bounce-back prevention is an important aspect of the damping net 18 since any balls that bounce back onto the court 26 cannot be automatically delivered the ball propulsion device 22 and must be manually picked up and dropped into the trough 24 to enable their reuse.

The damping net 18 is therefore constructed with appropriate tension and mounted at a predetermined distance from the back wall 12 to prevent it from touching the back wall 12 upon being struck by a moving ball. Another factor considered during construction of the damping net 18 is to reduce and ideally eliminate noise. The materials used in the damping net 18 and the manufacturing properties thereof, and the position of the damping net 18 relative to the back wall 12, are thus predetermined prior to construction of the tennis ball collecting and returning installation 10 to provide for the desired damping and noise-cancellation characteristics.

During use of the tennis ball collecting and returning installation 10, a moving ball will strike the damping net 18, pushing the damping net 18 back toward the back wall 12, but ideally not cause the damping net 18 to touch the vinyl sheet 36 on the back wall 12. Rearward movement of the damping net 18 will stop before it touches the vinyl sheet 36 of the back wall 12 (arising from selection of appropriate tension of the damping net 18 and distance of the damping net 18 from the back wall 12), at which time the ball, having lost its forward momentum, will slide or fall downward along the damping net 18 into the trough 24 or fall downward away from the damping net 18 into the trough 24.

The distance between the damping net 18 and the vinyl sheet 36 can vary based on, for example, the dimensions of the damping net 18 since it is sought that the damping net 18 does not strike the vinyl sheet 36 when impacted by a ball. Thus, a wider damping net, i.e., with the width being the distance between the lateral edges of the damping net 18, will likely require a larger distance from the vinyl sheet 36 than a narrower damping net.

The opening 20 in the damping net 18 may be pre-formed when the damping net 18 is fabricated, or cut out from a pre-existing rectangular damping net. Opening 20 is necessary to allow balls being propelled from the ball propulsion device 22 to reach the court surface. Of course, it is a problem if the opening 20 in the damping net 18 is too large because then there is a risk that the player will hit balls through the opening 20 and against the back wall 12. So appropriate dimensioning of the opening 20 is important. As shown, opening 20 is significantly larger than the ball outlet opening 16 so only a portion of the opening 20 aligns with the ball outlet opening 16.

To increase the likelihood that the balls that strike the damping net 18 and fall into the trough 24 do not bounce out of the trough 24, the trough 24 is provided with side walls 52 that extend above the court surface from the back wall 12 to a location in front of the damping net 18, for example, a few inches in front of the damping net 18. The trough 24 also includes a front wall 54 extending from one lateral side of the damping net 18 to the other lateral side of the damping net 18 and connecting at its lateral end regions to front regions of the side walls 52. A lower part 36 of the back wall 12, the side walls 52 and the front wall 54 define a ball-catching receptacle 56 into which balls that strike the damping net 18 fall.

A bottom surface of the trough 24 is lined with a layer of damping material 58 to damp motion of the balls, i.e., to deaden them. One possible damping material is foam. In this manner, once a ball falls into the trough 24 and onto the foam lining, it will no longer bounce and thus will not go back onto the playing court 26. Also, the foam reduces and possibly eliminates any noise as the balls fall into the trough 24.

The height of the front wall 54 of the trough is selected to prevent any balls from bouncing out of the trough 22 onto the court 26. The height of the front wall 54 may be slightly shorter than a height of a tennis net that is represented by the line 42 on the vinyl sheet 36. This will aid in the practice of the tennis game by enabling the player to assess their ball hitting relative to the net, i.e., try to get the ball over the net line 42 without interference from the front wall 54. The height of the front wall 54 should be as high as possible though to avoid having balls fall from the damping net 18 onto the court 26 or bounce from the trough 24 onto the court 26.

The free, bottom edge of the damping net 18 should be at or below the height of the front wall 54 to ensure that any balls passing over the front wall 54 strike the damping net 18 and not the back wall 12, or more specifically, the vinyl sheet 36 thereof.

The trough 24 also includes guide structure to guide any balls falling into it to the ball inlet opening 14 of the back wall 12. This guide structure, or guide means, may be one or more ramps 60 angled downward from an upper region of an inside surface of the side walls 52 and from an upper region of an inside surface of the front wall 54 to the ball inlet opening 14. As such, any ball dropping into the trough 24 will roll toward the ball inlet opening 14. Instead of ramps, other structures that achieve the same objective of causing balls to roll into the ball inlet opening 14 may be provided in the trough 24. The ball inlet opening 14 may be in a central region of the back wall 12, midway between the lateral edges of the back wall 12, although its placement is not at all critical to the invention as long as the guide structure in the trough 24 guides the balls to the ball inlet opening 14.

A housing defining a ball collection receptacle 62 (FIG. 2) is behind the back wall 12 and is directly behind the ball inlet opening 14 to thereby receive balls from the trough 24 that are guided thereby to pass through the ball inlet opening 14. The ball propulsion device 22 is provided with or associated with a conduit 64 to obtain balls from the ball collection receptacle 62 and bring them to an inlet of the ball propulsion device 22 to be propelled onto the court 26. Since the ball inlet opening 14 is below the ball outlet opening 16, the ball propulsion device 22 is arranged on an elevated platform 66 to elevate it above the ball collection receptacle 62. The ball propulsion device 22 may be any known device.

The conduit 64 may be a suction-type of conduit that pulls the balls to the inlet of the ball propulsion device 22. More generally, the conduit from the ball collection receptacle 62 below the ball propulsion device 22 to the inlet of the ball propulsion device 22 is representative of feed means for feeding or enabling feed of balls from the ball collection receptacle 62 to the inlet of the ball propulsion device 22, and known ball conveyance mechanism, whether utilizing a vacuum type of feed or mechanical, ma be used in the invention.

An advantage of elevating the ball propulsion device 22 is that the ball outlet of the ball propulsion device 22 can be oriented at a lower elevation angle relative to the pickleball court 26, and even at a negative angle to a plane parallel to the pickleball court 26 at the outlet of the ball propulsion device 22. Normally, if the ball propulsion device 22 were to be situated at ground level, it would be necessary to provide for an upward trajectory of the balls from the outlet of the ball propulsion device to clear the net in front of the ball propulsion device 22. Here, however, since the ball propulsion device 22 is elevated about 20-25 inches from the surface of the court 26, the outlet of the ball propulsion device 22 is higher than the net 28 so that the trajectory from such an elevated position could be horizontal or even downward and still clear the net 28 in front of the ball propulsion device 22. This reduces the amount of space needed between the ball propulsion device 22 and the tennis serve line 30.

The net 28 may be mounted on a frame that has wheels to enable its movability relative to the tennis ball collecting and returning installation 10, with the wheels being manipulatable to prevent their movement. As such, the net 28 can be moved to different positions dependent on the desires of the player using the tennis ball collecting and returning installation 10 for training or practice purposes, and then fixed in each of those positions. In a preferred configuration, the net 28 is moved to a position about 10 feet from the tennis ball collecting and returning installation 10, i.e., from the front court-facing surface of the trough 24, which provides for improved safety by preventing balls being hit by the player from rolling toward the player and has also been found to be more convenient in that balls hit by the player that are not caught by the tennis ball collecting and returning installation 10 will be centralized in front of the net 28.

As used herein, a sports court is a type of playing surface for some sports, such as tennis, pickleball, badminton, or squash. Courts have different dimensions, shapes, and materials depending on the sport and the level of play, and typically include a net between two sides of the court. The tennis ball collecting and returning installation 10 can be installed with any such type of court, and is not limited to any particular sports court. Moreover, it is not required that the playing surface be specifically designated for playing a sport, i.e., as a sports court. Rather, the tennis ball collecting and returning installation 10 can be situated on any level surface and used to provide a steady flow of balls to the user to hit into the tennis ball collecting and returning installation 10, and receive them in return. The sports court is also not required to include a net since the tennis ball collecting and returning installation 10 can be used without a net on the court. Although described as a tennis ball collecting and returning installation 10, i.e., for use with tennis balls, the collecting and returning installation 10 is not limited to tennis balls and may be configured for use with other types of balls, for example, for different sports.

The tennis ball collecting and returning installation 10 can be configured as an entirely portable system, i.e., the back wall 12 and its support structure, the damping net 18 and its mounting structure, the trough 24 and its support structure, and the ball propulsion device 22 and the structure to feed balls from the trough 24 thereto, may be mounted on a portable frame and moved, for example, from place to place within the same facility as desired. This increases the versatility of the system in that one facility with multiple courts can have a single tennis ball collecting and returning installation 10 for its courts, and move it wherever it is needed. Modifications to enable the portability of the tennis ball collecting and returning installation 10 could include making the support structure of the trough 24 from a lightweight material, e.g., aluminum, and in multiple, interlocking parts. The other parts of the trough 24 would be the same.

In another variant, there will be multiple versions of the back wall 12 and the vinyl sheet 36 thereon, e.g., different shapes, numbers and positions of targets 40 on the vinyl sheet 36. For example, there could the three different vinyl sheets 36 each designed for a specific training drill, and the sheets are changed to correlate to the drill being practiced.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A ball collecting and returning installation, comprising:

a back wall including a ball inlet opening and a ball outlet opening;

a damping net spaced apart from and in front of said back wall, said damping net having an opening at least partly aligning with said ball outlet opening;

a trough below said damping net and extending from said back wall to a location in front of said damping net, said trough including guide system for guiding balls landing in said trough to said ball inlet opening; and a ball propulsion device behind said back wall and configured to receive balls that passed through said ball inlet opening and propel the balls through said ball outlet opening.

2. The installation of claim 1, wherein said back wall comprises a vinyl sheet on a front side above said trough, said vinyl sheet having an opening aligning with said ball outlet opening.

3. The installation of claim 2, wherein said vinyl sheet comprises a plurality of targets marked on said vinyl sheet correlated to targeted areas into which to hit balls during use of the installation.

4. The installation of claim 2, wherein said vinyl sheet comprises a horizontal line at a height of a tennis net relative to a surface of a ball court on which the installation is located.

5. The installation of claim 1, wherein said damping net is fixed in position a distance from about 6 inches to about 18 inches from said back wall over its entirety, whereby the set distance is determined to prevent said damping net from contacting said back wall upon being stricken by a hit ball.

6. The installation of claim 1, wherein said damping net is fixed at its lateral edges and its upper edge to at least one stationary structure, and a bottom edge of said damping net is free and over said trough.

7. The installation of claim 1, wherein said damping net has a tension to damp movement of a ball striking said damping net to thereby cause the ball to roll along said damping net into said trough or drop from said damping net into said trough.

8. The installation of claim 1, further comprising damping material lining said trough to damp movement of balls falling into said trough.

9. The installation of claim 1, wherein said trough comprises opposed side walls projecting from said back wall and a front wall connected to and extending between a front region of said side walls to define a ball catching receptacle.

10. The installation of claim 9, wherein said front wall has a height at or above a bottom edge of said damping net.

11. The installation of claim 1, further comprising a ball collection receptacle behind said back wall and positioned to receive balls passing through said ball inlet opening, said ball propulsion device being elevated above said ball collection receptacle and having a conduit to retrieve balls from said ball collection receptacle through which balls are transferred from said ball collection receptacle to an inlet of said ball propulsion device.

12. The installation of claim 11, further comprising a platform to elevate said ball propulsion device such that a trajectory of balls outlet from said ball propulsion device is downward and enables the balls to clear a court net.

13. A ball facility, comprising:

a sports court comprising a court surface and a net, the installation of claim 1 being situated at one end of said court surface;

said court surface including at least one tennis serve line each extending transversely across said court surface, said back wall including a horizontal line at a height of a tennis net, each of said at least one tennis serve line being positioned a distance of about 25 feet, about 30 feet, about 35 feet or about 36 feet from said back wall, whereby a player serving from said at least one tennis serve line assesses their serve by whether it impacts said damping net above or below said horizontal line.

14. The ball facility of claim 13, wherein the installation has the width of said sports court.

15. A method for installing a ball collecting and returning installation on a sports court, comprising:

providing a back wall including a ball inlet opening and a ball outlet opening at one end of a court surface of the court;

arranging a damping net spaced apart from and in front of the back wall, the damping net having an opening at least partly aligning with the ball outlet opening;

constructing a trough below a free lower edge of the damping net and extending from the back wall to a location in front of the damping net;

providing the trough with guide structure to guide balls landing in the trough to the ball inlet opening of the back wall;

positioning a ball propulsion device behind the back wall; and coupling an inlet of the ball propulsion device to a ball collection receptacle into which the balls pass from the trough such that balls falling from the damping net into the trough are conveyed to the ball propulsion device to be outlet onto the court.

16. The method of claim 15, further comprising:

arranging a vinyl sheet on a front side of the back wall above the trough, the vinyl sheet having an opening aligning with the ball outlet opening; and placing a plurality of targets on a front side of the vinyl sheet correlated to targeted areas into which to hit balls.

17. The method of claim 16, wherein the court includes a court net, further comprising:

placing a horizontal line on the front side of the vinyl sheet at a height of a tennis net relative to a surface of the court; and placing at least one tennis serve line on the court surface extending transversely across the court surface each at a distance of about 25 feet, about 30 feet, about 35 feet or about 36 feet from the back wall, whereby a player serving from one of the tennis serve lines assesses their serve by whether it impacts the damping net above or below the horizontal line.

18. The method of claim 15, wherein the step of arranging the damping net spaced apart from and in front of the back wall comprise fixing lateral edges of the damping net to fixed support structure on lateral sides of the damping net and fixing an upper edge of the damping net to fixed structure above the court surface.

19. The method of claim 15, further comprising selecting a distance at which the damping net is spaced apart from the back wall and tension of the damping net to prevent the damping net from contacting the back wall upon being stricken by a hit ball.

20. The method of claim 15, wherein the court includes a court net, further comprising positioning the ball propulsion device on a platform above the ball collection receptacle to elevate the ball propulsion device above the court surface such that a trajectory of balls outlet from the ball propulsion device is downward and enables the balls to clear the court net.

* * * * *